United States Patent [19]

Gibson

[11] Patent Number: 4,589,658

[45] Date of Patent: May 20, 1986

[54] POWER SQUAT, WEIGHT LIFTING APPARATUS

[76] Inventor: Russell K. Gibson, 7504 Winesap Way, Louisville, Ky. 40228

[21] Appl. No.: 517,195

[22] Filed: Jul. 26, 1983

[51] Int. Cl.[4] ..... A63B 21/00

[52] U.S. Cl. ..... 272/134; 272/119; 272/117

[58] Field of Search ..... 272/93, 117, 119, 123, 272/130, 134, 137, 138, 139, 143, 142, DIG. 2, DIG. 5, DIG. 4; 128/25 R, 75, 78, DIG. 15; 2/311, 309, 312, 338

[56] References Cited

U.S. PATENT DOCUMENTS

| | | | |
|---|---|---|---|
| 87,465 | 3/1869 | Butler | 272/117 |
| 882,181 | 3/1908 | Thomas | 272/143 |
| 3,057,354 | 10/1962 | Roberts et al. | 128/DIG. 15 |
| 3,911,907 | 10/1975 | Smith | 272/DIG. 4 X |
| 4,340,218 | 7/1982 | Wilkinson | 272/142 X |

FOREIGN PATENT DOCUMENTS

| | | | |
|---|---|---|---|
| 2112846 | 6/1972 | France | 2/312 |

*Primary Examiner*—Richard J. Apley
*Assistant Examiner*—William R. Browne
*Attorney, Agent, or Firm*—Richard L. Caslin

[57] ABSTRACT

A weight lifting apparatus is shown to enable the user to perform power squat lifts to develop leg strength throughout the hips, thighs, and calf leg muscles, while at the same time eliminating back injuries to the user. The user is provided with a waist harness having front and rear straps suspended from a heavy belt down between the legs of the user. The belt has interior padding that extends above the top edge and below the bottom edge of the belt. The harness is connected to a weight holder by an adjustable chain so that all of the weight is carried by the lower half of the body. The weights remain below the user's body, and the center of gravity of the weights remains below the user's center of gravity. This apparatus is formed as an elevated rack having a pair of elongated platforms separated by a well section. The user straddles the platforms and the weights remain within the well section. Steps are formed at one end of the platform serving as an entrance at the rear of the apparatus for mounting and dismounting the rack. There is a weight holder having a base with a vertical post for supporting a variety of different weights. Three sides of the rack are provided with a hand rail, where the front rail is grasped by the user while the power squats are being performed.

10 Claims, 10 Drawing Figures

POWER SQUAT, WEIGHT LIFTING APPARATUS

BACKGROUND OF THE INVENTION

1. Field of the Invention

This invention relates to the art of weight lifting apparatus to a waist harness and, particularly, for use in building leg strength, while at the same time eliminating back injuries to the user. This weight lifting apparatus exerts no load on the user's upper body while the user is performing power squats.

2. Description of the Prior Art

A patent to Kane U.S. Pat. No. 3,640,529 describes an exercising apparatus for barbell-type exercises for the development and strengthening of major portions of the body, including arms and legs. Instead of using weights or barbells, this apparatus uses tension springs that provide the forces against which the user's body is exerted. If this Kane apparatus were used for power squat lifts, the user would raise the crossbar and place it behind his neck and across his shoulders in a manner similar to a barbell. This apparatus has the same failings as a barbell used for power squat lifts because such an apparatus would place a great deal of weight and strain on the lower back area which is due largely to the inability of the user to keep his back straight, thus creating a "roll-over" effect. This type of apparatus as taught by Kane is the prior art which the present inventor is trying to render obsolete with the present invention.

The Kruthaupt U.S. Pat. No. 3,701,529 shows exercising apparatus where a platform is yieldably mounted in a vertical supporting frame. A plurality of horizontal bars are mounted on the sides of the frame vertically above the platform. The user stands on the platform and exerts pressure or force against the horizontal bars, and this force is transmitted through the arms of the user to the shoulders and down through the upper body and through the legs to the platform which moves vertically downward against the resistance of a plurality of tension springs. This Kruthaupt apparatus exerts forces throughout the entire body of the user. This user may perform power squat lifts, but the forces of the weights in the form of the resisting springs are transmitted throughout the user's entire body and are not limited to below the waist, as in the present invention.

The Yamauchi U.S. Pat. No. 3,751,031 describes a weight belt from the rear of which is suspended a vertically adjustable link member that is joined to a weight holder. This exercise harness was apparently devised for use as physical therapy apparatus to assist in curing waist pain. A cushioning means is installed around the periphery of the weights so that the ankles and feet of the user may be protected from injury while the weights swing forward and rearward or from side to side. The weight suspended from the adjustable connecting member to the weight belt appears to be a dangerous instrument that may do serious harm to the user's feet and ankles during the exercise motions. This patented design appears to be an incomplete experiment that would be dangerous to operate. Anyone comparing this apparatus of the patent with the present invention would certainly adopt the present Applicant's inventive contribution to this art as compared with the prior art discussed above.

OBJECTS OF THE PRESENT INVENTION

The principal object of the present invention is to provide weight lifting apparatus for performing power squat lifts by use of an elevated rack having a pair of elongated platforms separated by a well section in combination with the use of a waist harness suspended from a weight belt having oversized interior padding so that all of the weight is carried by the lower body thereby eliminating back injuries to the user.

A further object of the present invention is to provide a power squat, weight lifting apparatus of the class described where the user's feet and ankles are protected from injury by the weights suspended from the padded waist harness while the user exercises between a full standing position and a full squat position.

A further object of the present invention is to provide weight lifting apparatus of the class described where safety features are built into the apparatus to ensure that the user does not lose his balance and fall, as well as to ensure that the user's feet do not slip off the apparatus and cause injury.

A further object of the present invention is to provide weight lifting apparatus of the class described with the use of hand rails which are grasped by the user while performing the exercises so as to stabilize the body and avoid losing balance.

A still further object of the present invention is to provide weight lifting apparatus of the class described with a novel waist harness that is suspended from a padded weight belt so that the center of gravity of the weights remains in line with the user's center of gravity, and the harness is convenient to use without discomfort or injury.

SUMMARY OF THE INVENTION

The present invention provides weight lifting apparatus for use in power squat lifts for strengthening the leg muscles while eliminating back injuries to the user. Such apparatus has an elevated rack with a pair of elongated platforms separated by a well section. Steps are formed at one end of the platforms serving as a rear entrance to the apparatus. A weight holder includes a base and a vertical post for supporting a variety of different weights thereon. A waist harness is adapted to be suspended from a heavy belt with interior padding that extends above and below the belt, and the lower end of the harness is located below the crotch area between the user's legs. An adjustable chain joins the harness to the post of the weight holder. The user is able to perform power squat lifts by positioning himself on the two platforms, thereby straddling the well section and allowing the weight holder to be positioned within the well section when the user is standing in a full upright position. The platforms are of such a height that the user may lower himself into a full squat position without the weight holder touching the floor.

BRIEF DESCRIPTION OF THE DRAWINGS

This invention will be better understood from the following description taken in conjunction with the accompanying drawings, and its scope will be pointed out in the appended claims.

DESCRIPTION OF THE PREFERRED EMBODIMENTS

Figure 1:
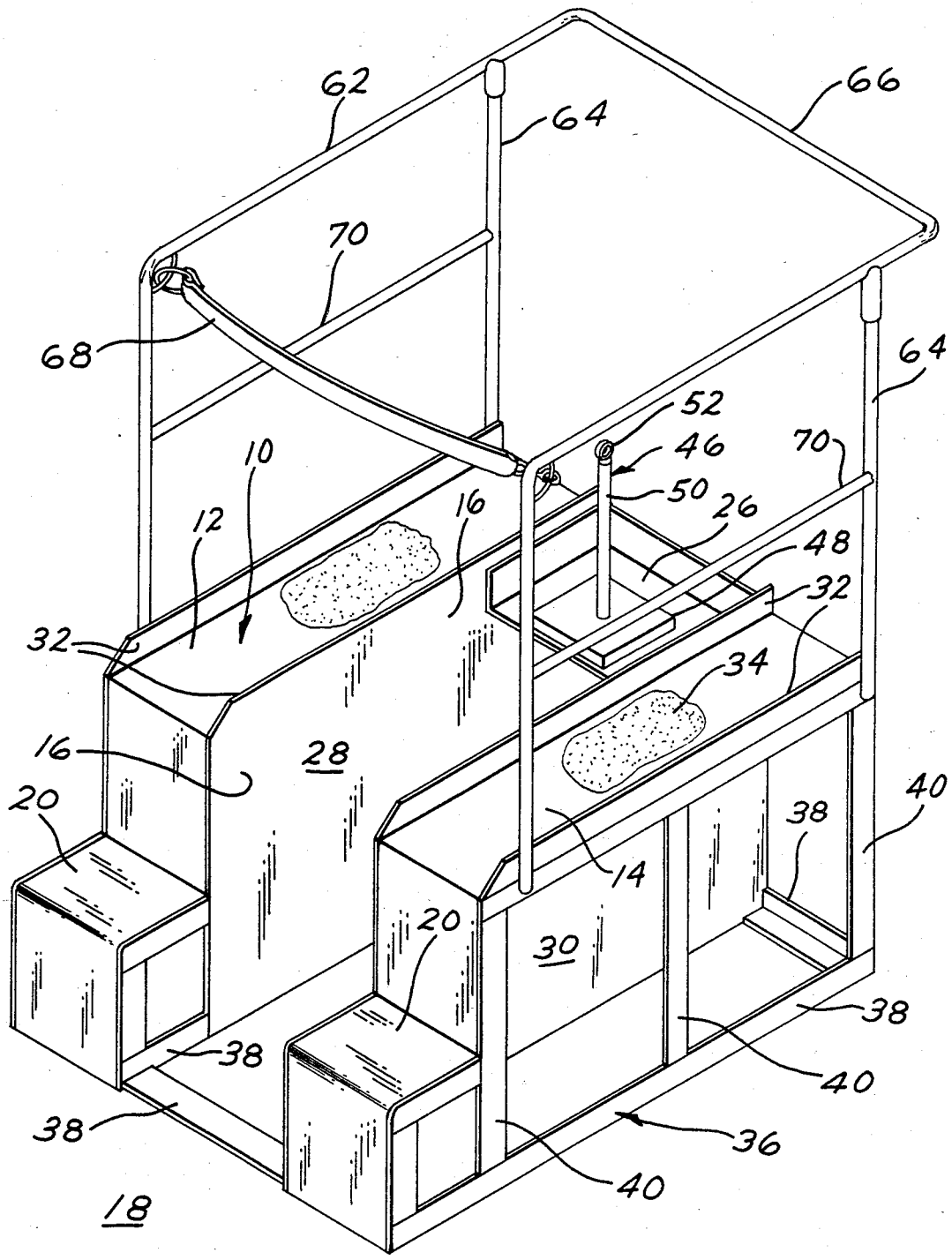
FIG. 1 is a perspective view of the elevated rack of the weight lifting apparatus of the present invention as seen from the rear entrance end of the apparatus where the steps make it possible for the user to mount and dismount the rack. Notice the weight holder with the vertical post positioned on a supporting shelf at the front end of the well section between the two elongated platforms. Also notice the hand railing around the three sides of the elevated rack, except for the rear entrance end, so as to prevent the user from losing his balance. A flexible belt could be used to close the railings at the rear entrance end.

Turning now to a consideration of the drawings, and in particular to the perspective view of FIG. 1, there is shown the weight lifting apparatus of the present invention comprising an elevated rack 10 formed with a pair of elongated platforms 12 and 14 which are separated by a well section 16 that extends down to the floor 18 on which this elevated rack is supported. A step 20 is formed at the nearest end of each elongated platform 12 and 14 to render it convenient to mount and dismount the rack. This end of the rack with the steps 20, 20 is considered as the rear entrance of the rack. The opposite end 22 is considered as the front end of the rack.

A supporting shelf is positioned within the well section 16 near the front end 22 of the rack, and it is fastened in place by suitable means (not shown). The well section 16 is defined by opposite vertical sidewalls 28 and 30 which extend from the floor 18 up to the platforms 12 and 14. Notice that these sidewalls 28 and 30 are solid so as to avoid interfering with the up and down movement of the weights. Each side of each elongated platform is provided with a raised surface 32 to form curbing to prevent the user's feet from slipping sideways off of the platform, it being understood that the user will straddle the well section 16 by placing one foot on each platform 12 and 14. Each platform 12 and 14 may be provided with a roughened patterned tread 34 to increase the traction and prevent the shoes from slipping while the user is occupying the elevated rack. The elevated rack 10 has a base 36 for resting on the floor. This base is formed by a series of elongated metal bars 38 which are joined together with the steps 20 and the vertical sidewalls 28 and 30 of the well section 16, in combination with a series of vertical elongated bars 40 serving as vertical strut members to support the step 20 and the raised platforms 12 and 14.

As a general proposition, the dimensions of this elevated rack 10 are not critical, however some sample dimensions will be given to present some idea of the overall size and shape of the elevated rack 10. The platforms 12 and 14 are elevated at about two feet off of the floor, which means that the well section 16 is about two feet in depth. Each elongated platform 12 and 14 is about three feet in length, and about ten inches in width. The width of the well section is about 15 inches, which would make the overall width of the rack about 35 inches. It is understood that variations in these dimensions can be made without departing from the scope of the present invention.

Figure 4:
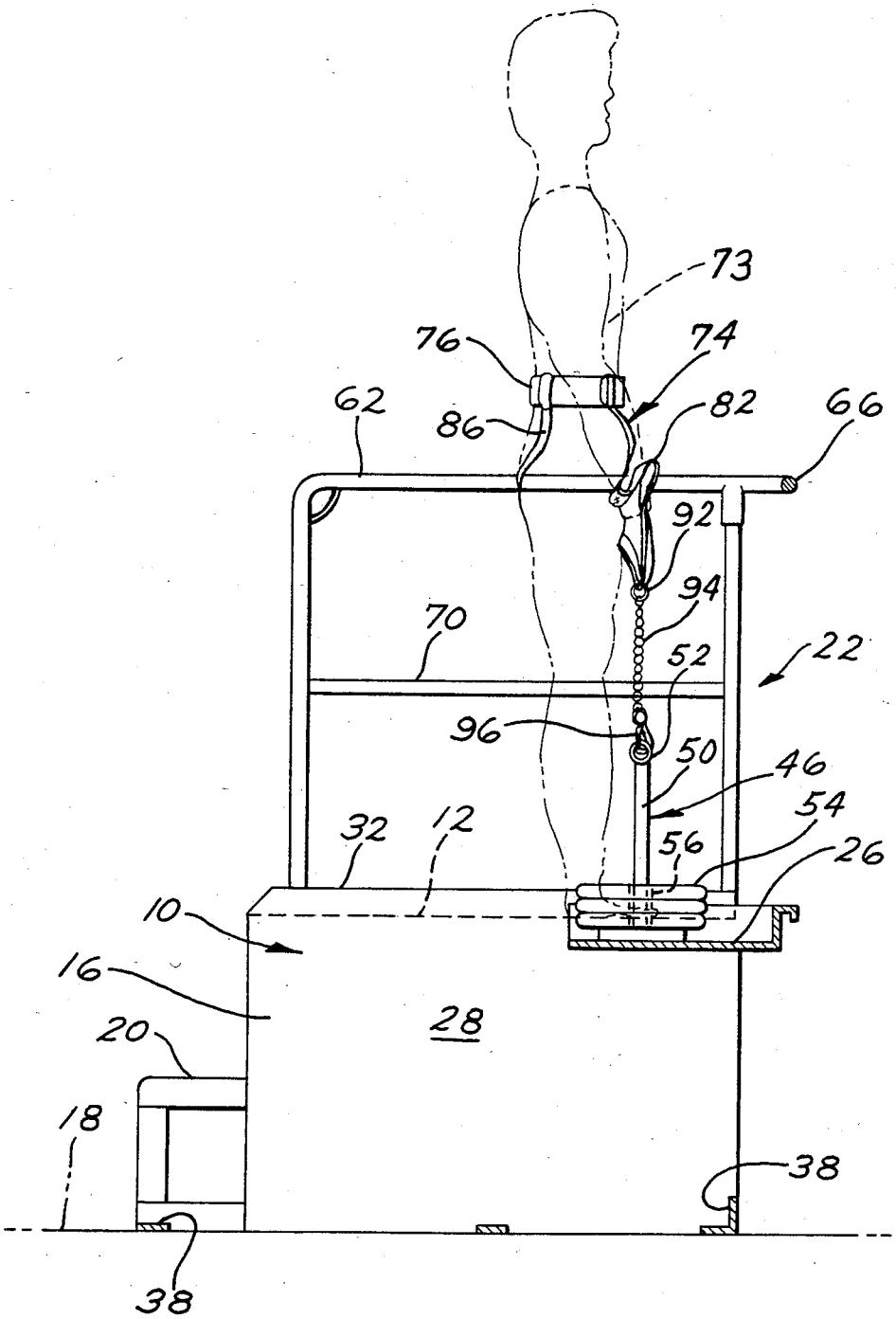
FIG. 4 is a right side, cross-sectional, elevational view of the elevated rack of FIG. 1 taken on a vertical plane located within the well section between the two elongated platforms, while the user is shown in phantom with a connecting chain joining the lower end of the waist harness to the upper end of the vertical post of the weight holder that is resting on the shelf at the front end of the well section just prior to the beginning of the exercising activity.

Looking at FIG. 1, the recessed shelf 26 is shown supporting a weight holder 46 that has a flat base 48 with a central vertical post 50 having a ring member 52 fastened on the top end thereof. This weight holder 46 is adapted to receive and support a plurality of standard weights 54, as is best seen in FIG. 4. Each weight 54 is generally of flat disc shape with a central hole 56 which receives the vertical post 50 as the weights are lowered until the weights are supported on the base 48. This way the weights are confined in place and cannot become separated from the holder 46 accidentally.

A hand rail 62 is formed around three sides of the elevated rack 10, which three sides are the three sides other than the rear entrance side of the rack. Four corner posts 64 are used as the vertical support means of the hand rail 62. Notice that the hand rail section 66 at the front end 22 of the rack 10 projects outwardly beyond the front end 22 of the two platforms 12 and 14, as is best understood with relation to FIG. 6, so that when the user 73 grasps this rail section 66, his arms may be fully extended while his body is generally centered along the length of the two platforms 12 and 14. Said in another way, the platforms 12 and 14 need not be as long as the opposite side rails 62. Of course, the smaller the elevated rack 10 is, the less it weighs and the easier it is to move around when it is necessary that it be moved. For the sake of safety, a flexible belt 68 is shown fastened across the opposite hand rails at the rear entrance of the rack. This belt would be fastened in place once the user has mounted the rack and is ready to begin exercising. When this belt 68 is in place, as shown in FIG. 1, it provides an additional precaution against falling if the user were to lose his balance. This belt 68 would be used mostly by beginning body builders, while the trained body builder would probably not use it.

A lower-level hand rail 70 is installed on the two opposite sides of the rack 10, again as a convenience, for use by people who may have made the mistake of adding too many weights 54 to the weight holder 46 and were having trouble in raising the weights once they reached the full squat position. These lower-level hand rails 70 could be used to assist the lifter in helping himself back to the standing position until he has developed enough strength in his leg muscles to avoid having this happen.

Figure 2:
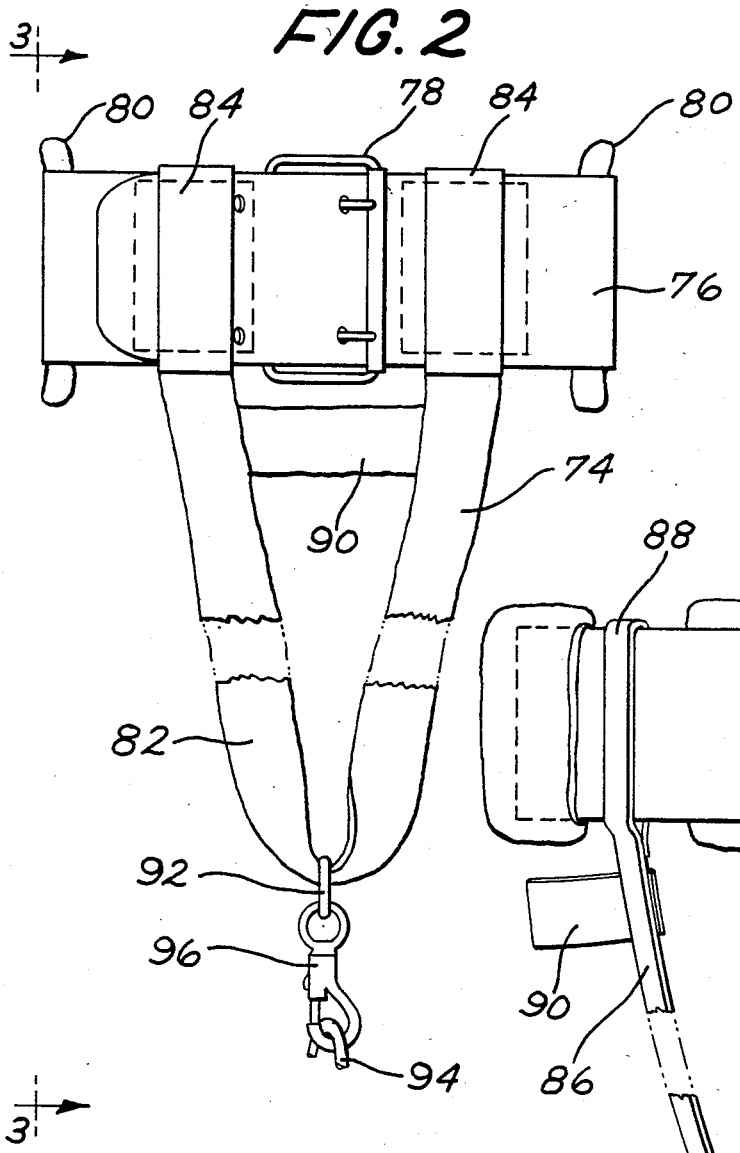
FIG. 2 is a front elevational view of one modification of waist harness that is suspended from a padded weight belt where the interior padding extends above and below the belt. The lower end of the harness is arranged between the user's legs so that the weights will be suspended from the harness down between the user's legs when the user is straddling the well section with one foot on each platform.
Figure 3:
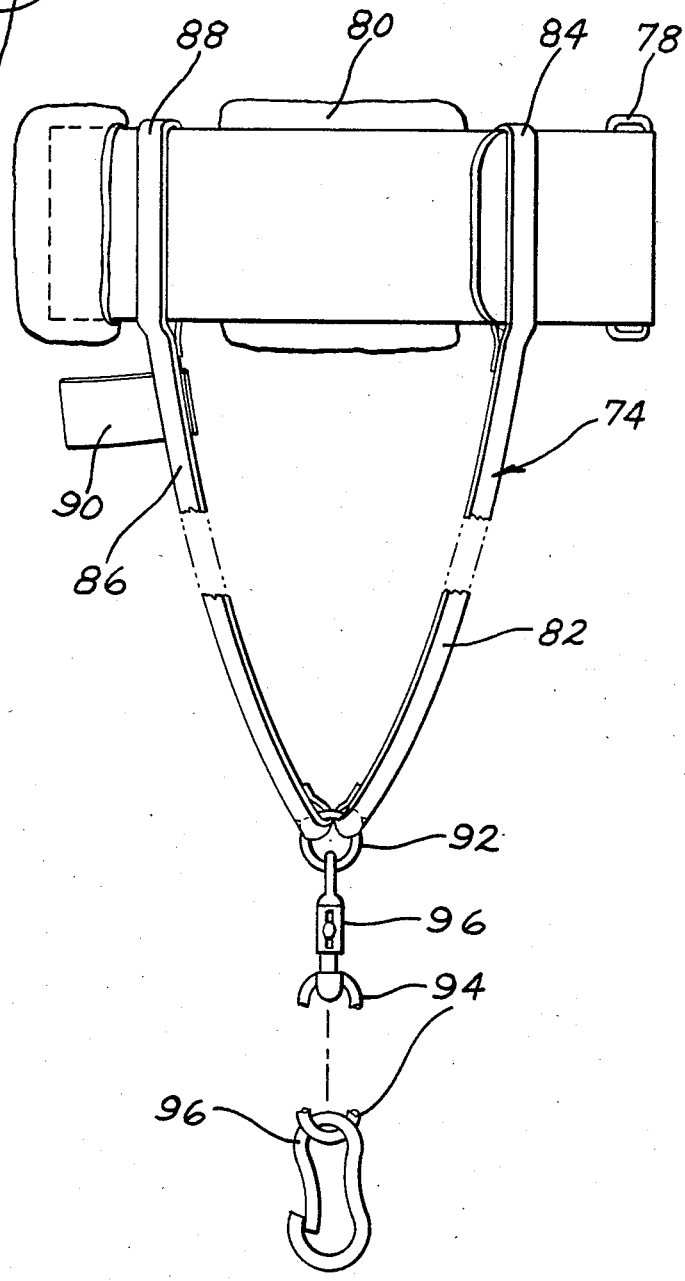
FIG. 3 is a right side elevational view of the weight harness taken on the line 3—3 of FIG. 2 showing a front strap suspended from the front of the padded weight belt and a rear strap suspended from the rear of the same belt. A ring member joins the lower ends of both front and rear straps in an area between the legs of the user so that when the weights are suspended from the lower end of the waist harness, the vector of force will be directed in a vertical direction through the center of gravity of the user.

FIGS. 2 and 3 show an early embodiment of the waist harness 74 used in the present invention. This waist harness 74 is adapted to be suspended from a weight belt 76 that is widely used by body builders and is readily available in gymnasiums and health spas. A standard weight belt 76 is usually of leather and is about four inches in width with a heavy metal buckle 78 at the front. Because of the heavy loads carried by this weight belt 76 when used with the weight harness 74 with the present invention, it has been found expedient to add cushioning means or padding 80 of fleece lining, or the like, on the inner side of the weight belt 76 so as to prevent abrasion against the skin of the user as the weights 54 are being raised and lowered during the power squat lifts. This interior padding extends above the top edge and below the bottom edge of the belt. The waist harness 74 comprises a V-shaped front strap 82 that is suspended from the front of the weight belt 76, as best seen in FIG. 2. This strap 82 is formed of a nylon woven material very similar to that used in automobile seat belts. Both of the upper ends 84 of the strap are formed with wide loop sections through which the weight belt 76 is threaded. It should be understood that the waist harness 74 also includes a V-shaped rear strap 86 that is similar in nature to the front strap 82, as can be seen in the right side view of FIG. 3. This rear strap 86 also has loop sections 88 similar to loop sections 84 of the front strap so that the rear strap can be threaded onto the weight belt 76. A short, horizontal cross-strap 90 is furnished on the rear strap 86 only.

A ring member 92 joins the lower ends of both front and rear straps, as is best seen in FIG. 3, so that an adjustable connecting member 94 in the form of a link chain may be connected between this ring member 92 and the ring member 52 at the upper end of the vertical post 50 of the weight holder 46. See FIG. 4. A releasable fastener 96 is interposed between the ring member 92 and the adjustable connecting member or chain 94 so that the fastener may engage any one of the links of the link chain 94 in order to adjust the length of this connecting member 94, depending upon the height of the user. A similar releasable fastener 96 would be installed on the lower end of the link chain 94 for making engagement with the ring member 52 of the post 50. It is deemed well that the weight holder 46 always remain below the top edge of the curbing 32 of the elevated rack 10 so that the weights cannot swing sidewise and injure the user's feet or ankles when the user is standing in a full upright position.

FIG. 4 shows the user or lifter 73 suited up with the waist harness 74 suspended from a padded weight belt 76, and having the chain 94 fastened to the ring member 52 of the weight holder 46 that is, in turn, resting on the supporting shelf 26. This FIG. 4 shows the user or lifter 73 in either a START or a FINISH position on the elevated rack 10.

Figure 5:
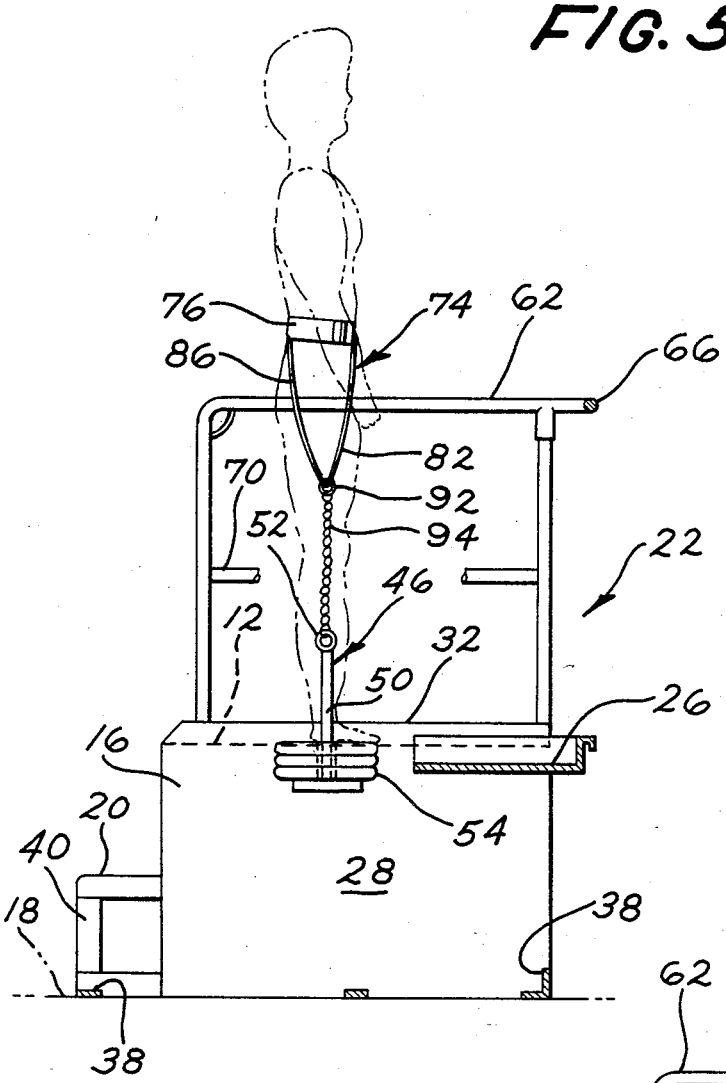
FIG. 5 is another right side, cross-sectional, elevational view of the elevated rack, similar to that of FIG. 4, again showing the user in phantom after having stepped backward so as to remove the weight holder from its supporting shelf in preparation for starting the power squat lifts after the user first grasps the hand railing at the front of the rack.

FIG. 5 shows an INTERMEDIATE position where the user has stepped backward to remove the weight holder 46 and its weights from the shelf 26. The user is in a full upright position with the weight holder 46 suspended between his legs by a chain 94 within the well section 16 from the waist harness 74.

Figure 6:
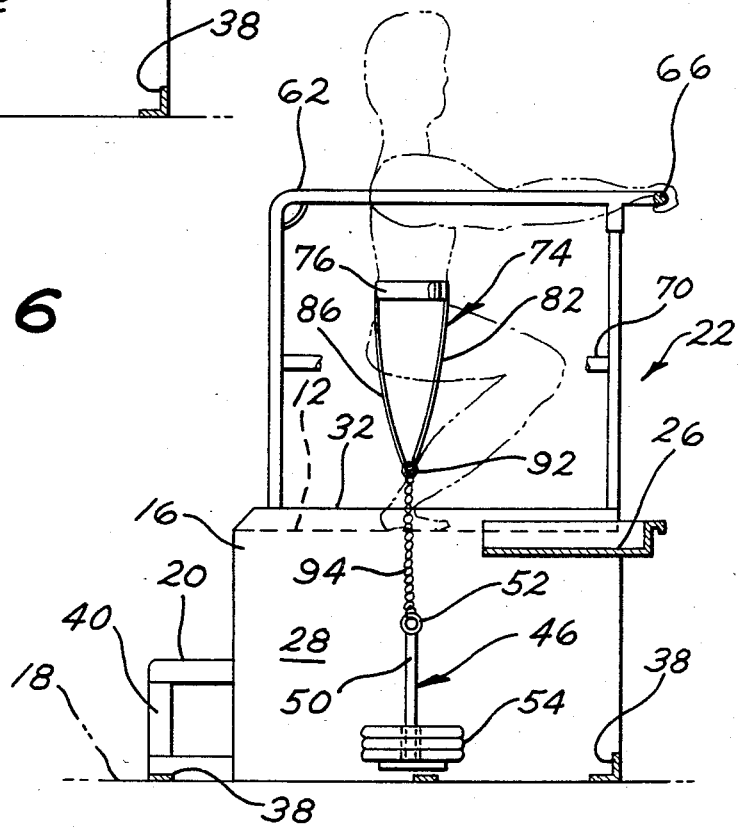
FIG. 6 is a view similar to that of FIG. 5, again showing the user in phantom moving down towards a full squat position.

FIG. 6 shows the user or lifter 73 with his arms fully outstretched engaging the front rail section 66, and the knees fully bent so the user is in a FULL SQUAT position, and the weight holder 46 is still raised up off of the floor 18.

Figure 7:
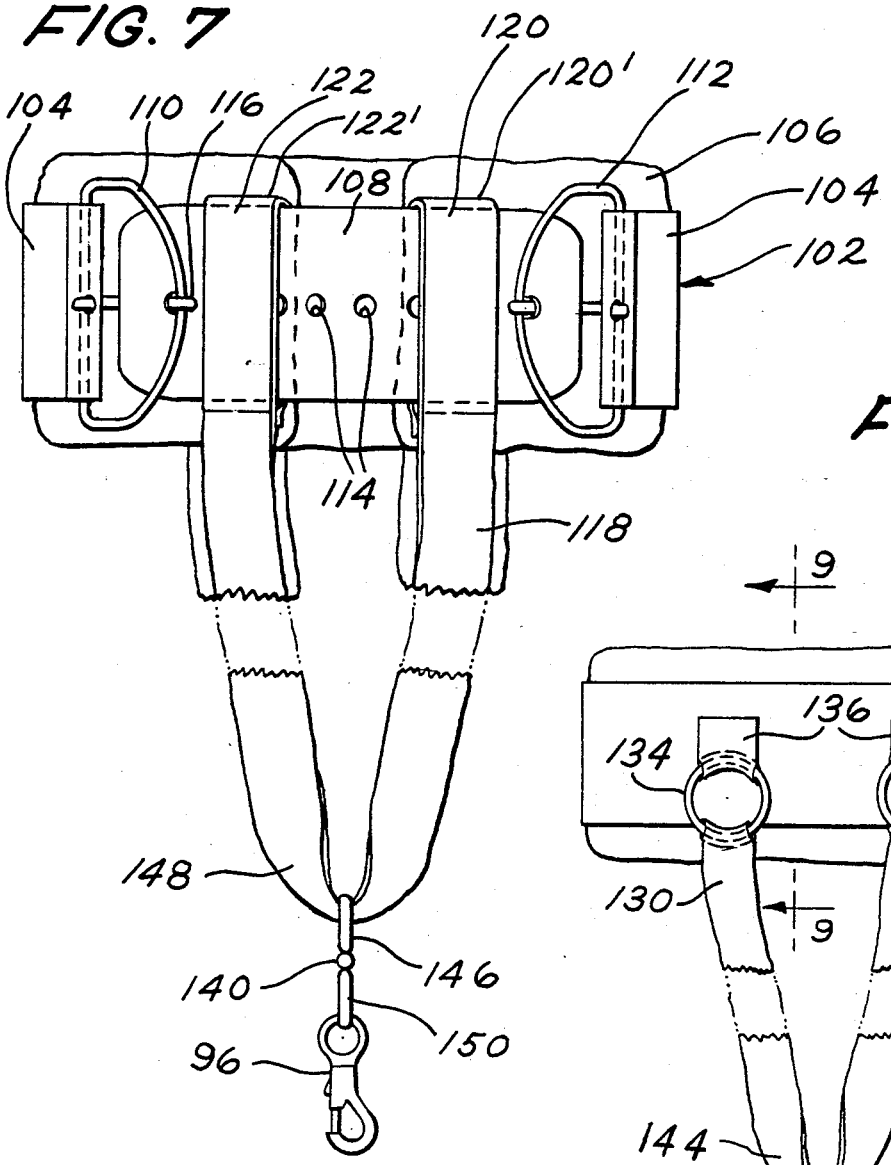
FIG. 7 is a front elevational view of the preferred embodiment of waist harness showing a shortened padded belt which is fleece-lined on the inside. The interior padding extends above the top edge of the belt and below the bottom edge of the belt. The front opening of the belt is closed by a short strap joined between a pair of buckles that form the two ends of the belt. The front harness strap is shown suspended by loops from the short strap.

FIG. 7 is the preferred embodiment of a waist harness 102 for use with the present invention. There is a shortened padded belt 104 which circumscribes about 4/5ths of the average user's waist dimensions. This belt 104 is fleece-lined with padding 106 on the inner surface thereof that extends above the top edge and below the bottom edge of the belt, so that the belt does not inflict injury to the user as the power squats are being carried out. The open front of the padded belt 104 is shown closed by a short, heavy strap 108 that is joined between a pair of spaced belt buckles 110 and 112 that are attached to the opposite ends of the padded belt 104. Notice the horizontal line of small holes 114 in the strap 108 that are each adapted to receive the tongue 116 of the adjacent belt buckle 110 or 112.

There is a front V-shaped strap 118 that has its two upper ends 120 and 122 formed with wide loop sections 120' and 122' respectively through which the short, heavy strap 108 is threaded.

It should be understood that the front strap 82 and the rear strap 86 of the first modification 74 of waist harness in FIGS. 1 and 2 could also be fleece-lined. The same is true of the preferred embodiment 102 of waist harness in FIGS. 7 and 8, with its front strap 118 and rear strap 128.

Figure 8:
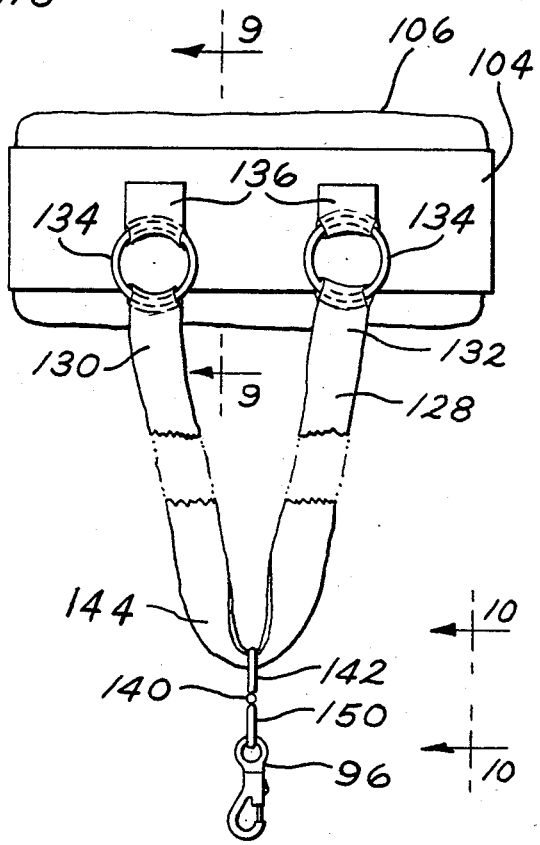
FIG. 8 is a rear elevational view, on a reduced scale, of the preferred waist harness of FIG. 7 showing the rear strap suspended from a pair of ring members that are attached to the padded belt as well as showing the oversized interior padding.

FIG. 8 is a rear elevational view of the preferred embodiment of the waist harness 102 of FIG. 7. A rear V-shaped strap 128 has two upper ends 130 and 132 joined to ring members 134 respectively, that are in turn attached to the outer side of the belt 104 by means of short strap members 136.

Figure 9:
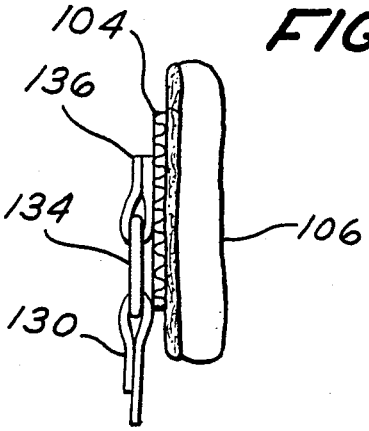
FIG. 9 is a fragmentary, cross-sectional, elevational view through the padded belt, taken on the line 9—9 of FIG. 8, showing the thick fleece lining on the inner surface of the belt.

FIG. 9 is a fragmentary, cross-sectional, elevational view, taken on the line 9—9 of FIG. 8, to show the various layers of materials.

Figure 10:
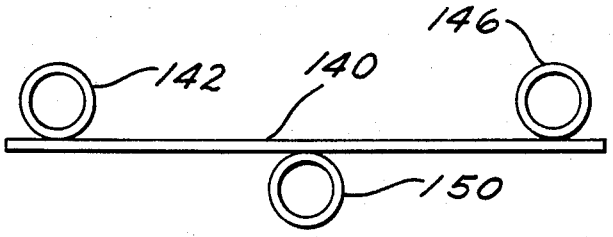
FIG. 10 is a fragmentary side elevational view, taken on the line 10—10 of FIG. 8, showing the elongated bar that joins the lower ends of the front and rear straps.

FIG. 10 is a fragmentary side elevational view, taken on the line 10—10 of FIG. 8, to show an elongated bar 140 that serves to join the lower ends of the front and rear straps at a spaced distance. A first, upper ring member 142 is attached to the upper edge at the rear end of the bar 140 to receive the lower end 144 of the rear strap 128 of FIG. 8 therethrough. A second, upper ring member 146 is attached to the upper edge at the front end of the bar 140 to receive the lower end 148 of the front strap 118 of FIG. 7 therethrough.

The lower edge of the bar 140 is fitted with a central ring member 150 for receiving a releasable fastener 96 that is capable of engaging the adjustable chain 94 of FIG. 4 to conform to the height of the user or lifter 73.

Having described above the novel invention of weight lifting apparatus for use with power squat lifts, it will readily be apparent to those skilled in this art that the use of the present invention ensures correct squat form in that it discourages the previous tendency of the lifter to lean forward from the waist and to use his back and arm muscles for lifting the weights up after reaching the full squat position, thereby cheating because the legs were not doing all of the lifting. Previously, the back and arms were providing some of the lifting, and the legs did not receive the full benefit of the weights. Moreover, the use of the present invention eliminates back injuries since all of the weight is carried by the lower body. The use of the present invention concentrates the entire weight to be lifted in the large leg muscles, such as the front quadriceps and the back hamstring leg muscles. Finally, the center of gravity of the weight tends to shift so as to be in direct line with the center of gravity of the body of the user.

The actual squatting exercise technique is to be performed by doing a parallel squat, or slightly below parallel, meaning that the thighs are generally parallel with the floor. It has been found harmful if the lifter bounces his weight so that his buttocks touches his ankles. The amount of weight, the number of sets and repetitions, the rate of work, and the deviation of rest intervals between each set is to be determined by the philosophy of training in the sport the lifter participates in. The apparatus of the present invention is designed to build leg strength throughout the hips, thighs, and calf leg muscles. These muscles make up the most powerful and largest muscles in the body. The stronger these muscle groups are result in more flexion action, which is the range of joint motion, as well as increase in the stability of joints these muscles surround.

Modifications of this invention will occur to those skilled in this art. Therefore, it is to be understood that this invention is not limited to the particular embodiments disclosed, but that it is intended to cover all modifications which are within the true spirit and scope of this invention as claimed.

What is claimed is:

1. A power squat, weight lifting apparatus for strengthening the leg muscles while eliminating back injuries to the user, said apparatus comprising:

a. an elevated rack having a pair of elongated platforms that are separated by a well section;

b. step means at one end of the pair of platforms serving as an entrance for mounting and dismounting the rack;

c. a weight holder having a base with a vertical post for supporting a variety of weights;

d. and a waist harness including a heavy belt with interior padding that extends above the top edge and below the bottom edge of the belt, and strap means suspended from the belt between the legs of the user, said strap means including a V-shaped front strap suspended from the front of the belt, and a V-shaped rear strap suspended from the rear of the same belt, and a connector member joining the lower ends of both front and rear straps, and adjustable connecting means for joining the said connector member to the upper end of the said post of the weight holder, said post being unobstructed and freely supported by said waist harness when in use;

e. whereby the weights are adapted to be connected to said connector member and are fully supported from the padded waist harness during the complete power squats performed by the user over the well and the user may exercise with the weights carried by the weight holder operating within the well section while the user moves between a full standing position and a full squatting position so that the weight is carried solely by the user's lower body.

2. The weight lifting apparatus as recited in claim 1 with a shelf positioned across the said well section at the front end of the platforms that is opposite the rear entrance for supporting the weight holder and its weights after they are disconnected from the said waist harness.

3. The weight lifting apparatus as recited in claim 1 wherein there is a hand railing on at least the front side of the elevated rack that is opposite the rear of the rack for serving as a steadying means when grasped by the user during the exercising.

4. The weight lifting apparatus as recited in claim 1 wherein there is a hand railing on at least three sides of the elevated rack other than the entrance of the rack to prevent the user from losing his balance.

5. The weight lifting apparatus as recited in claim 4 wherein said hand rail having a second lower railing positioned on opposite sides of the rack.

6. The weight lifting apparatus as recited in claim 5 wherein the section of hand railing opposite the entrance side of the rack extends outwardly from the adjacent edge of the rack, so that when extended railing is grasped by the user during exercising, the user's feet are generally centered along the length of the elongated platforms.

7. The weight lifting apparatus as recited in claim 1 with raised surfaces extending along each elongated side of each platform of the pair of platforms so as to form curbing to prevent the user's feet from slipping sidewise off the platforms.

8. The weight lifting apparatus as recited in claim 1 wherein the said waist harness has a connector member in the form of an elongated bar joining the lower ends of both front and rear straps at a spaced distance, the said adjustable connecting means being suspended from the underside of the said bar.

9. The weight lifting apparatus as recited in claim 1 wherein the said padded belt has a first shortened belt section that is open at the front, there being a belt buckle attached adjacent each end of the shortened belt section, and a short, heavy strap member attached between the said pair of belt buckles serving to complete the said shortened belt, and the said strap means of the waist harness comprising both a V-shaped front strap suspended from the said short heavy strap member, and a V-shaped rear strap suspended from the rear side of the said shortened belt section, and an elongated bar joining the lower ends of both front and rear straps at a spaced distance, the said adjustable connecting means being suspended from the said bar.

10. A waist harness for use by a person in supporting heavy weights down between the feet of the user when doing power squats over a well, said waist harness including a heavy two-piece belt having a first shortened belt section that is open at the front, there being a belt buckle attached adjacent each end of the shortened belt section to be near the hips of the user, and padding attached to the interior side of this shortened belt section and extending above the top edge and below the bottom edge of this belt section, and a short, heavy strap member attached between the said pair of belt buckles serving to complete the said shortened belt, and strap means suspended from the two-piece belt between the legs of the user, said strap means comprising both a V-shaped front strap suspended from the said short, heavy strap member, and a V-shaped rear strap suspended from the rear side of the said shortened belt section, and an elongated bar joining the lower ends of both front and rear straps at a spaced distance, and an adjustable connecting chain suspended from the connection of the two V-shaped straps, and a free end of said chain being engageable with a weight to be lifted, whereby weights can be fully supported from the padded waist harness during the complete power squats performed by the user over a well.

* * * * *